US010109948B2

(12) United States Patent
Zhao et al.

(10) Patent No.: US 10,109,948 B2
(45) Date of Patent: Oct. 23, 2018

(54) ELECTRICAL CONNECTOR AND METHOD OF MAKING THE SAME

(71) Applicant: FOXCONN INTERCONNECT TECHNOLOGY LIMITED, Grand Cayman (KY)

(72) Inventors: Jun Zhao, Huaian (CN); Tao Yao, Huaian (CN); Cai-Yun Zhang, Huaian (CN)

(73) Assignee: FOXCONN INTERCONNECT TECHNOLOGY LIMITED, Grand Cayman (KY)

( * ) Notice: Subject to any disclaimer, the term of this patent is extended or adjusted under 35 U.S.C. 154(b) by 0 days.

(21) Appl. No.: 15/476,980

(22) Filed: Apr. 1, 2017

(65) Prior Publication Data

US 2017/0288360 A1 Oct. 5, 2017

(30) Foreign Application Priority Data

Apr. 1, 2016 (CN) ..... 2016 1 0198779

(51) Int. Cl.
*H01R 12/72* (2011.01)
*H01R 13/52* (2006.01)
(Continued)

(52) U.S. Cl.
CPC ..... *H01R 13/5219* (2013.01); *H01R 13/6587* (2013.01); *H01R 12/724* (2013.01); *H01R 24/60* (2013.01); *H01R 43/005* (2013.01)

(58) Field of Classification Search
CPC .. H01R 12/714; H01R 12/721; H01R 12/722; H01R 13/5202; H01R 13/521;
(Continued)

(56) References Cited

U.S. PATENT DOCUMENTS 5,100,336 A * 3/1992 Burgess ..... H01R 13/424 439/277
5,720,629 A * 2/1998 Self, Jr. ..... H01R 13/5208 439/274
(Continued)

FOREIGN PATENT DOCUMENTS

CN 202585913 12/2012
CN 203800282 8/2014
(Continued)

*Primary Examiner* — Edwin A. Leon Munoz
*Assistant Examiner* — Oscar Jimenez
(74) *Attorney, Agent, or Firm* — Wei Te Chung; Ming Chieh Chang

(57) ABSTRACT

An electrical connector includes an insulative housing, a number of conductive contacts affixed to the insulative housing, a middle shielding plate affixed to the insulative housing, a shielding shell enclosing the insulative housing for forming a mating room; and an outer metal shell enclosing the shielding shell. The insulative housing has a base portion and a tongue portion extending forwardly from the base portion. The electrical connector further includes a sealer with an o-ring at a front end thereof. The sealer is insert-molded with the shielding shell for forming a waterproof structure enclosing the insulative housing. A front end of the outer metal shell resists the sealer. The outer metal shell encloses the sealer, making the sealer attach to shielding shell firmly. The sealer achieves a good waterproof effect.

18 Claims, 9 Drawing Sheets

(51) Int. Cl.
*H01R 13/6587* (2011.01)
*H01R 24/60* (2011.01)
*H01R 43/00* (2006.01)

(58) Field of Classification Search
CPC ..... H01R 13/5216; H01R 13/5219; H01R 13/6581; H01R 13/6585; H01R 13/6594; H01R 13/6595; H01R 24/60
See application file for complete search history.

(56) References Cited

U.S. PATENT DOCUMENTS 6,045,383 A * 4/2000 Fujiwara ..... H01R 13/5219 439/271
6,994,590 B2 * 2/2006 Nishida ..... H01R 13/5219 439/271
8,052,467 B1 * 11/2011 Xie ..... H01R 13/6594 439/589
9,391,391 B2 7/2016 Chien
9,429,360 B2 8/2016 Hsiao
9,634,425 B1 * 4/2017 Hsu ..... H01R 13/5202
9,728,900 B1 * 8/2017 Tsai ..... H01R 13/6581
9,728,916 B1 * 8/2017 Tsai ..... H01R 24/60
9,893,459 B2 * 2/2018 Zhao ..... H01R 13/5219
2013/0183844 A1 * 7/2013 Wang ..... H01R 24/68 439/271
2014/0308833 A1 * 10/2014 Fukami ..... B29C 70/72 439/271
2014/0315439 A1 * 10/2014 Zhang ..... H01R 13/516 439/626
2015/0155661 A1 * 6/2015 Chen ..... H01R 13/6582 439/607.01
2016/0093974 A1 * 3/2016 Lai ..... H01R 13/5202 439/736
2016/0104957 A1 * 4/2016 Kim ..... H01R 13/5219 439/78
2016/0141792 A1 * 5/2016 Zhao ..... H01R 13/6581 439/78
2016/0156124 A1 * 6/2016 Hashimoto ..... H01R 13/5202 439/587
2016/0233594 A1 * 8/2016 Zhao ..... H01R 13/5202
2016/0294105 A1 * 10/2016 Zhao ..... H01R 13/5202
2017/0110818 A1 * 4/2017 Guo ..... H01R 12/716
2017/0162976 A1 * 6/2017 Zhao ..... H01R 4/02
2017/0271809 A1 * 9/2017 Fujii ..... H01R 13/6581
2017/0271823 A1 * 9/2017 Zhao ..... H01R 13/6596
2017/0288360 A1 * 10/2017 Zhao ..... H01R 43/205
2017/0294738 A1 * 10/2017 Zhao ..... H01R 13/5219
2017/0324186 A1 * 11/2017 Zhu ..... H01R 13/521
2017/0324187 A1 * 11/2017 Zhu ..... H01R 13/5202
2017/0324188 A1 * 11/2017 Guo ..... H01R 13/5219
2017/0338584 A1 * 11/2017 Yao ..... H01R 4/28
2018/0151978 A1 * 5/2018 Zhao ..... H01R 13/5208

FOREIGN PATENT DOCUMENTS

CN 104103949 A 10/2014
CN 203932465 11/2014
CN 204304093 4/2015
CN 204538337 8/2015
CN 204732590 10/2015
CN 205016762 2/2016
CN 205016763 2/2016
CN 105449443 A 3/2016

* cited by examiner

ELECTRICAL CONNECTOR AND METHOD OF MAKING THE SAME

BACKGROUND OF THE DISCLOSURE

1. Field of the Disclosure

The present disclosure relates to an electrical connector that has a good effect of waterproof and a method of making the electrical connector.

2. Description of Related Arts

U.S. Pat. No. 9,429,360 discloses an electrical connector comprising an insulative housing, a plurality of contacts affixed to the insulative housing, a metal shielding shell enclosing the insulative housing, and an outer seal located at a front end of the metal shielding shell. The seal prevents water from entering gaps between the electrical connector and an electrical device.

SUMMARY OF THE DISCLOSURE

Accordingly, an object of the present disclosure is to provide an electrical connector ensuring the waterproof of the electrical connector.

To achieve the above object, an electrical connector comprises: an insulative housing including a base portion and a tongue portion extending forwardly from the base portion; a plurality of upper and lower terminals affixed to the insulative housing; a middle shielding plate affixed to the insulative housing and sandwiched between the upper terminals and the lower terminals; a shielding shell attached to the insulative housing for forming a mating room; an outer metal shell enclosing the shielding shell; and a sealer insert-molded with the shielding shell to form a waterproof structure enclosing the insulative housing; wherein a front end of the outer metal shell resists the sealer.

Other objects, advantages and novel features of the disclosure will become more apparent from the following detailed description when taken in conjunction with the accompanying drawings.

DETAILED DESCRIPTION OF THE PREFERRED EMBODIMENT

Reference will now be made in detail to the preferred embodiment of the present disclosure.

Figure 1:
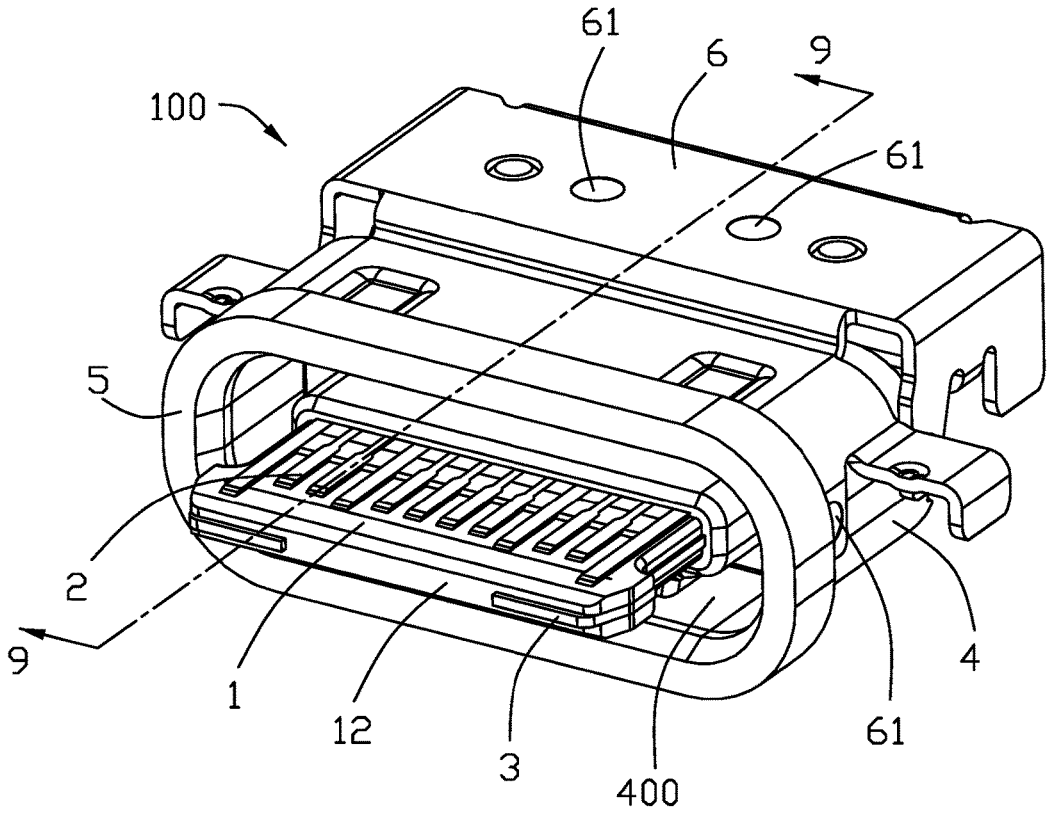
FIG. 1 is a perspective, assembled view of an electrical connector of the present disclosure.
Figure 2:
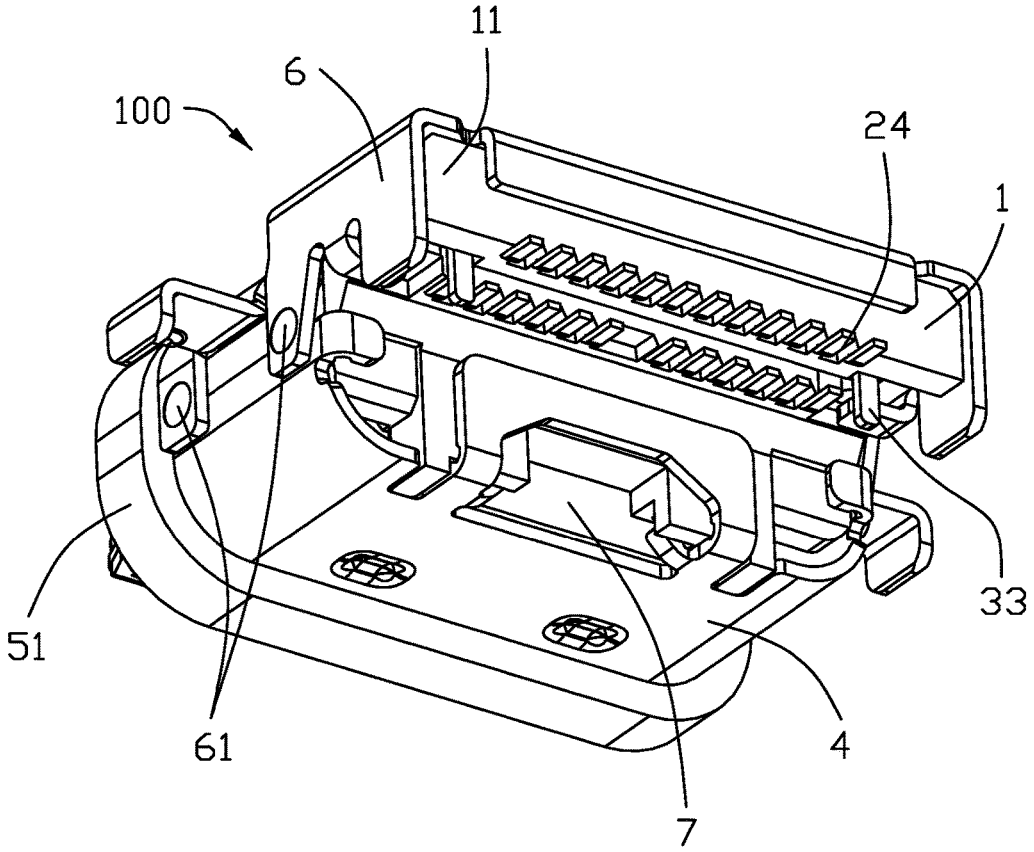
FIG. 2 is another perspective, assembled view of the electrical connector taken from FIG. 1.
Figure 3:
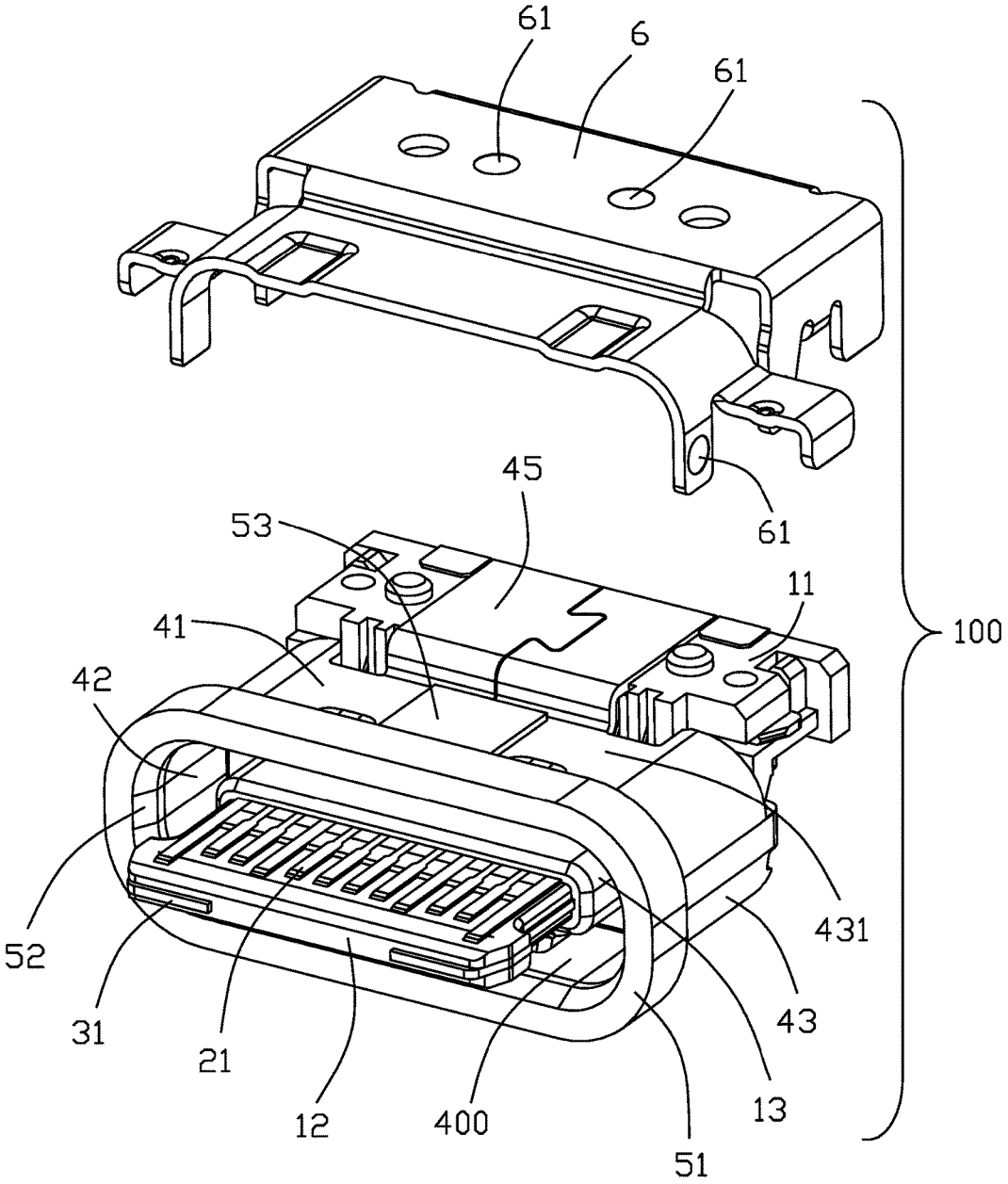
FIG. 3 is an exploded view of an outer metal shell and the other parts of the electrical connector.
Figure 4:
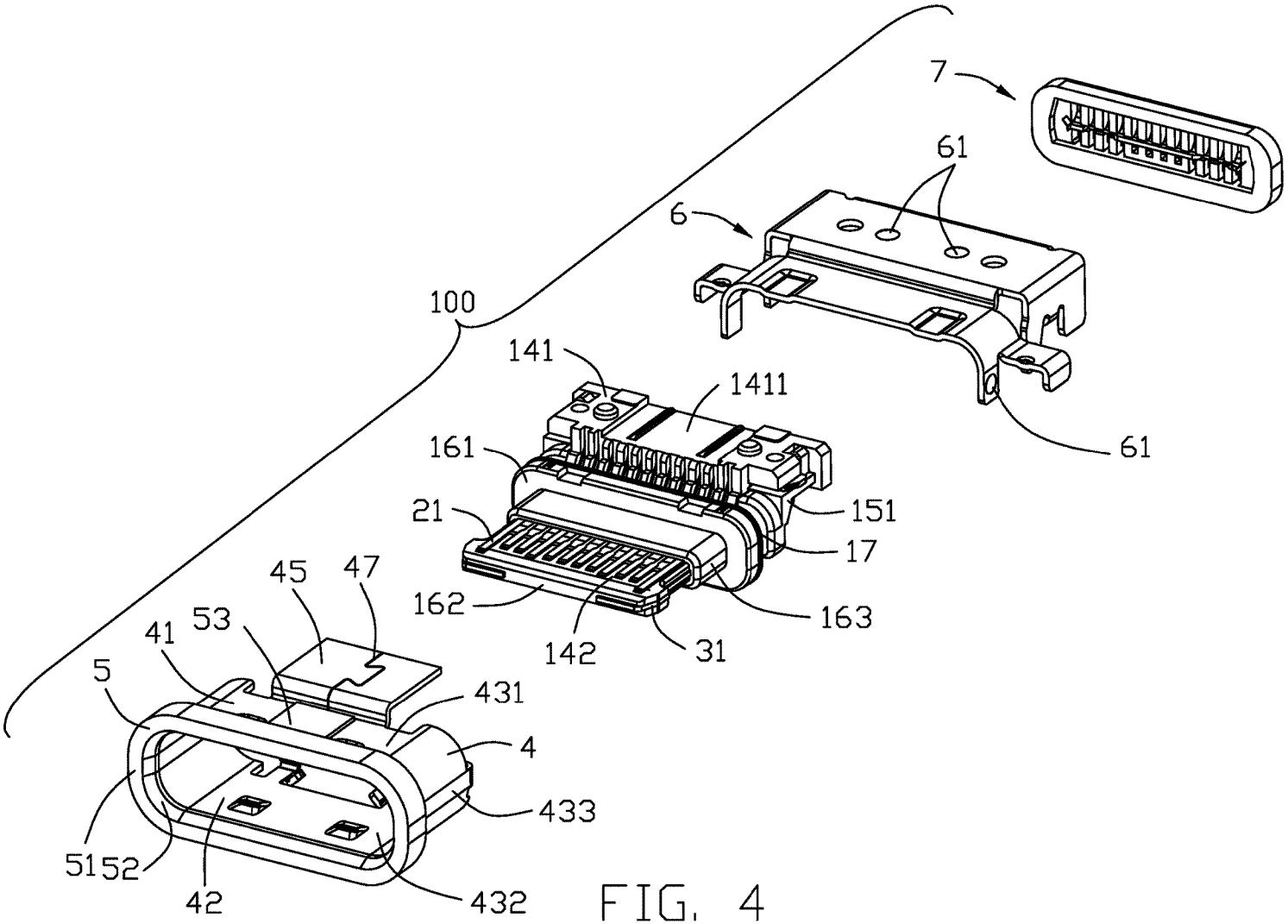
FIG. 4 is a further exploded view of the electrical connector taken from FIG. 3.
Figure 5:
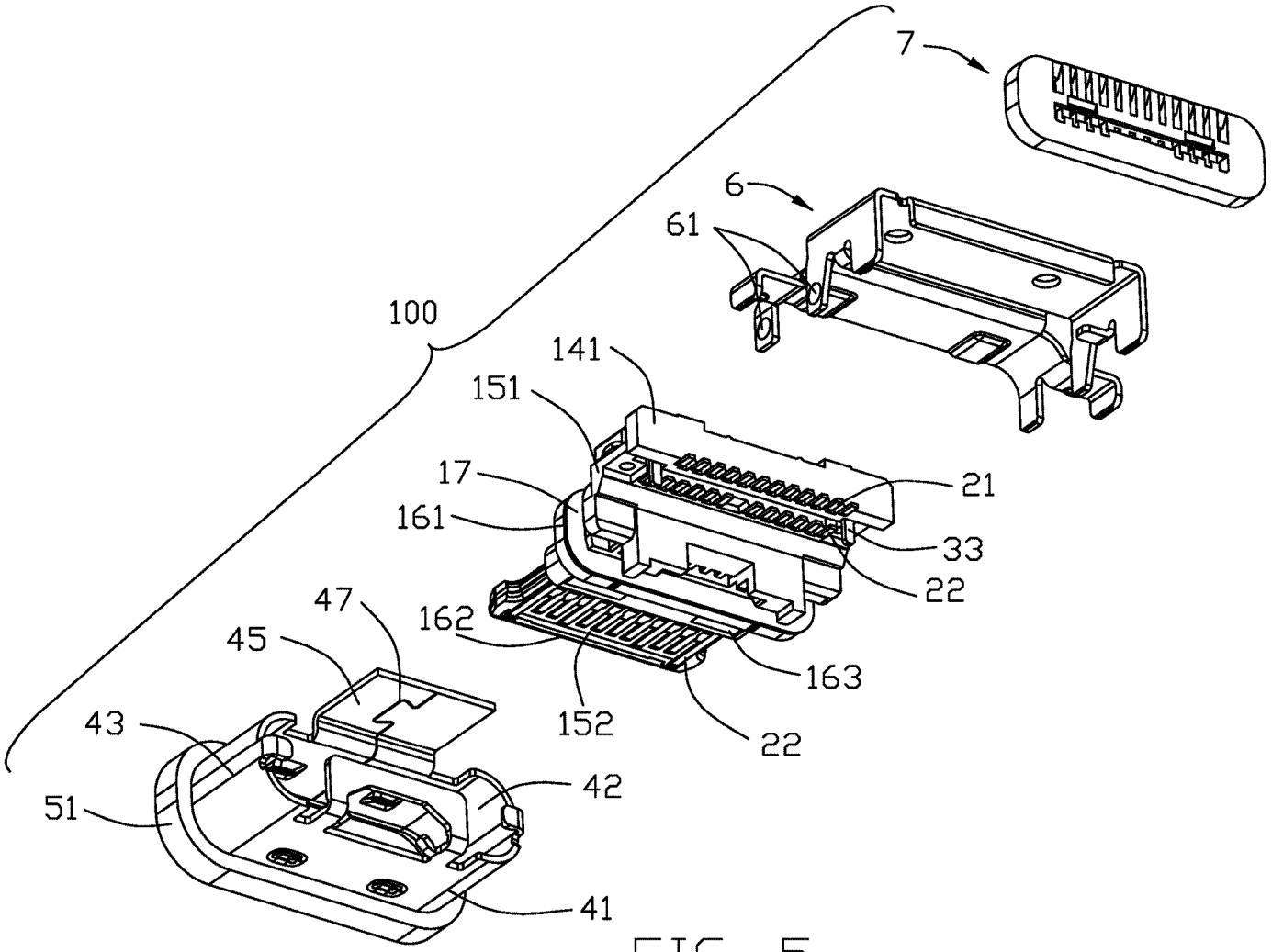
FIG. 5 is another perspective, exploded view of the electrical connector taken from FIG. 4.
Figure 6:
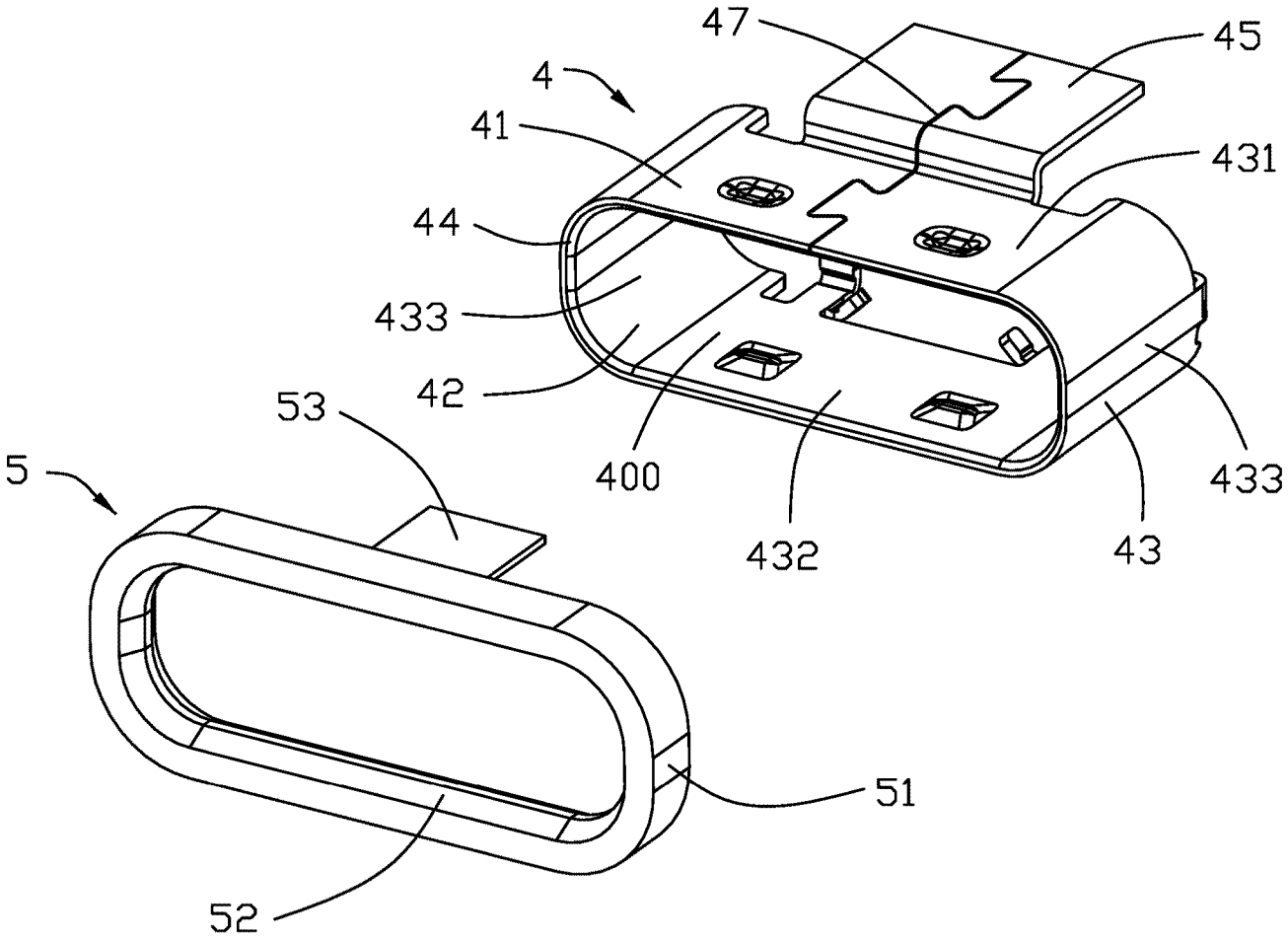
FIG. 6 is an exploded view of a sealer and a shielding shell of the electrical connector.
Figure 7:
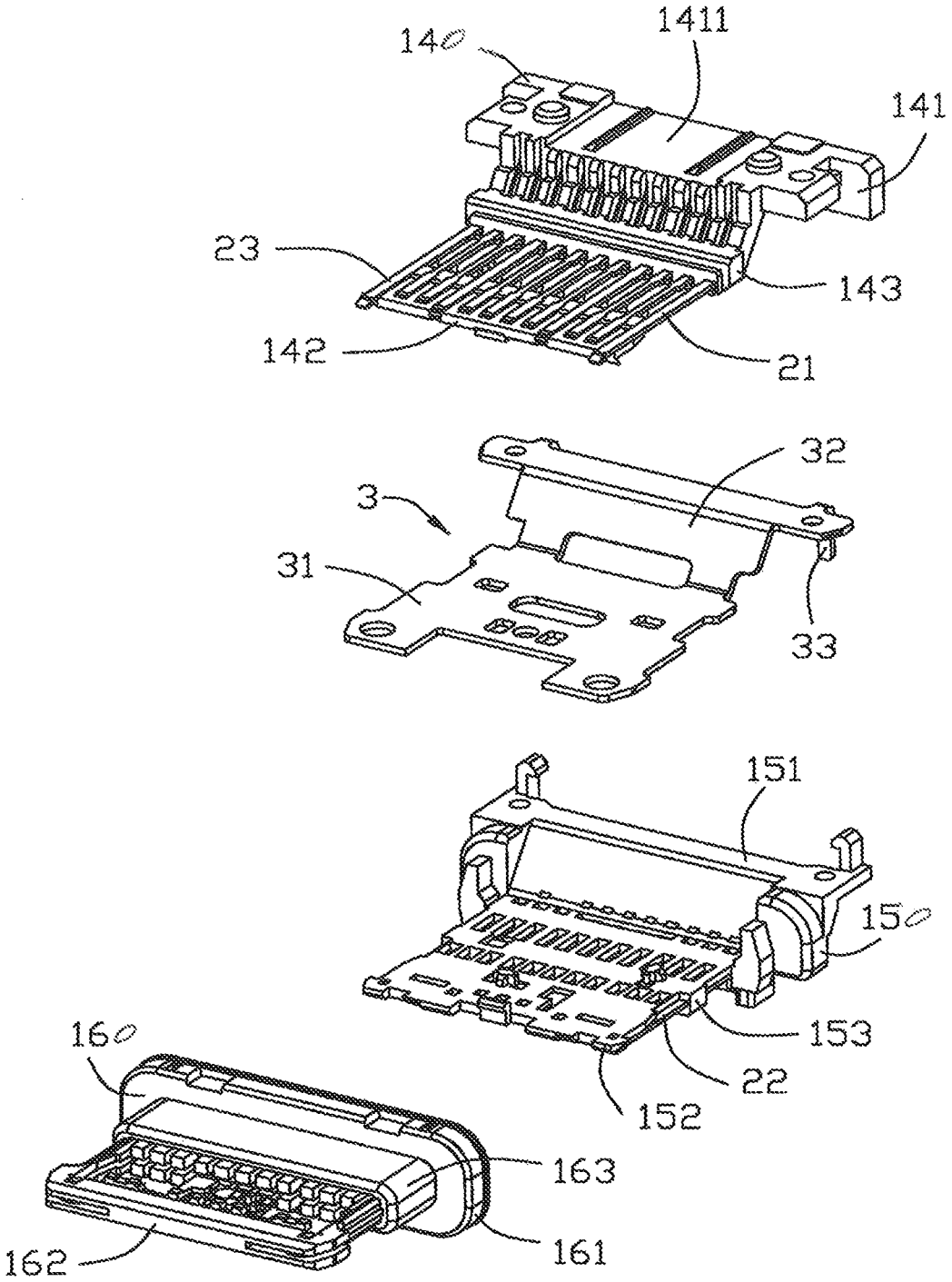
FIG. 7 is an exploded view of an insulative housing, a plurality of conductive contacts and a middle shielding plate of the electrical connector.
Figure 8:
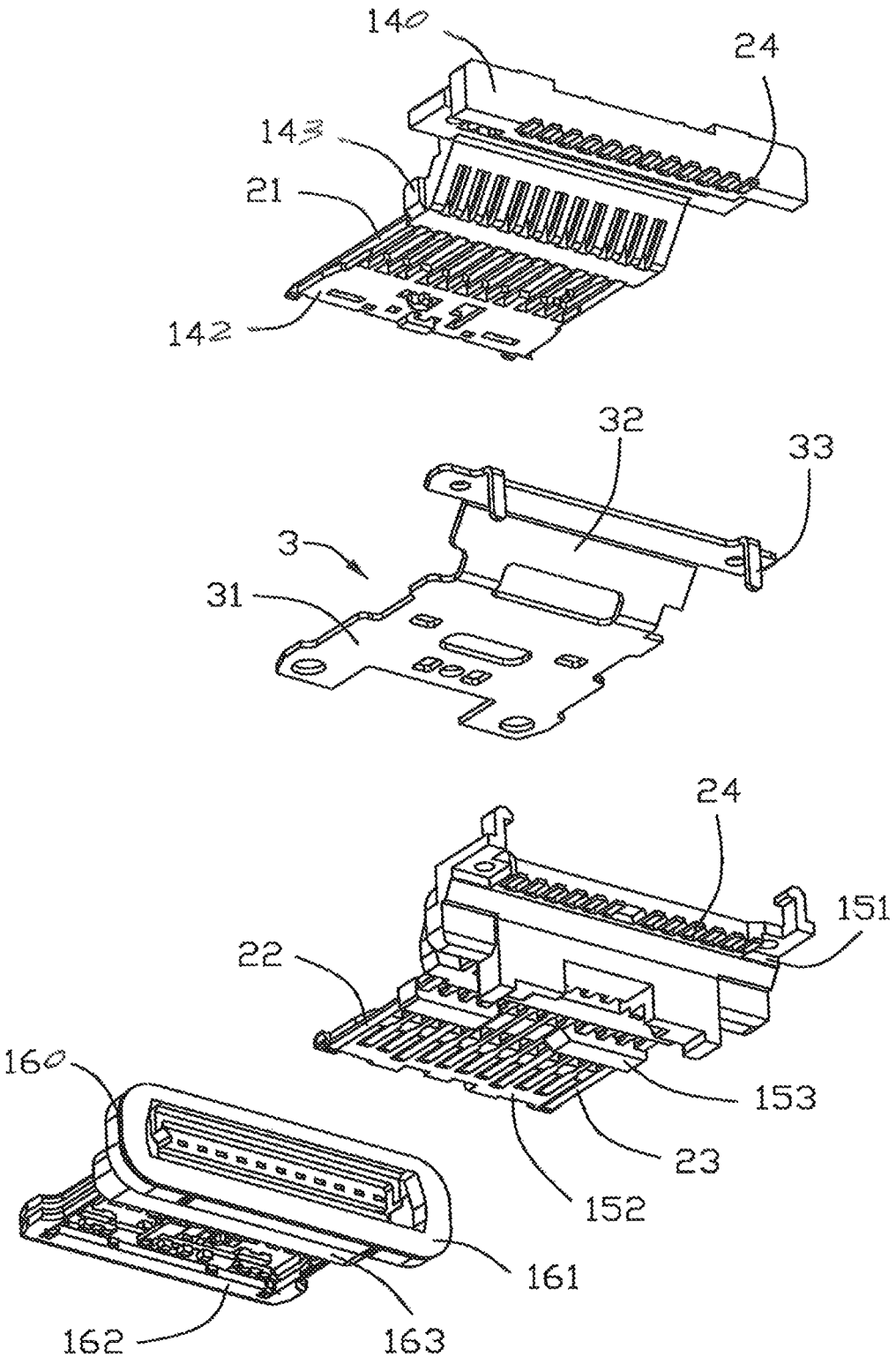
FIG. 8 is another exploded view of the electrical connector taken from FIG. 7.
Figure 9:
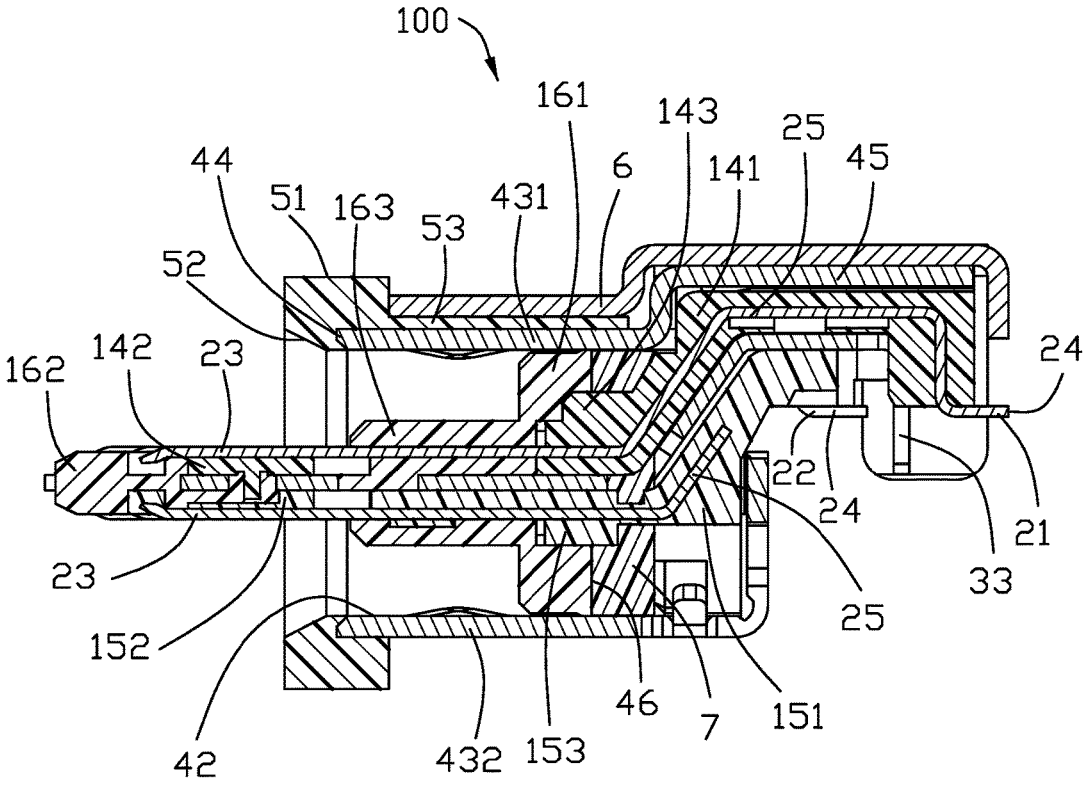
FIG. 9 is a cross-sectional view of the electrical connector taken along line 9-9 in FIG. 1.

Referring to FIGS. 1 to 9, an electrical connector 100 of the present disclosure, includes: an insulative housing 1, a number of conductive contacts 2 affixed to the insulative housing 1, a middle shielding plate 3 affixed to the insulative housing 1, a shielding shell 4 enclosing the insulative housing 1, a sealer 5 including an o-ring 51, and an outer metal shell 6.

Referring to FIGS. 1 to 5 and FIGS. 7 to 9, the insulative housing 1 including a base portion 11 with a connecting portion 13, and a tongue portion 12 extending forwardly from the base portion 11 along a front-to-back direction. The insulative housing 1 further includes an upper module 140, a lower module 150 and an insulator 160 overlapping the upper module 140 and the lower module 150.

The upper module 140 includes a first base portion 141 including a first connecting portion 143 and a first tongue portion 142 extending forwardly from the first base portion 141 along the front-to-back direction. The first base portion 141 includes a fixing groove 1411 on an upper surface of the first base portion 141. The lower module 150 includes a second base portion 151 having a second connecting portion 153 and a second tongue portion 152 extending forwardly from the second base portion 151. The insulator 160 includes a third base portion 161 having a third connecting portion 163 and a third tongue portion 162 extending forwardly from the third base portion 161. The lower module 150 is assembled to the upper module 140 along a bottom-to-top direction and located below the upper module 140. The first base portion 141, the second base portion 151 and the third base portion 161 compose the base portion 11. The first tongue portion 142, the second tongue portion 152 and the third tongue portion 162 compose the tongue portion 12. The first connecting portion 143, the second connecting portion 153 and the third connecting portion 163 compose the connecting portion 13. The upper module 140, the lower module 150 and the insulator are injection molded to compose the insulative housing 1.

Referring to FIGS. 4 to 5 and FIGS. 7 to 9, the insulative housing 1 includes a circle channel 17 located at the base portion 11. The first base portion 141, the second base portion 151 and the third base portion 161 form the circle channel 17 at a rear end thereof.

Referring to FIGS. 1 to 5 and FIGS. 7 to 9, each conductive contact 2 includes a contacting portion 23, a soldering portion 24 and a fixing portion 25 connecting the contacting portion 23 and the soldering portion 24. The conductive contacts 2 include a number of upper terminals 21 affixed to the upper module 140 and a number of lower terminals 22 affixed to the lower module 150. Each of the upper terminals 21 is associated with a respective one of the lower terminals 22 and is positioned in reverse symmetry with respect to the lower terminals 22. The contacting portions 23 of the upper terminals 21 are exposed to an upper surface of the first tongue portion 142. The soldering portions 24 of the upper terminals 21 are exposed to a rear end of the first base portion 141 and extending backwardly. The fixing portions 25 of the upper terminals 21 are affixed to the first base portion 141. The contacting portions 23 of the lower terminals 22 are exposed to a lower surface of the second tongue portion 152. The soldering portions 24 are exposed to a rear end of the second base portion 151 and extending backwardly. The fixing portions 25 of the lower terminals 22 are affixed to the second base portion 151. The soldering portions 24 of the upper terminals 21 are in the same plane with the soldering portions 24 of the lower terminals 22. The soldering portions 24 of the upper terminals 21 and the soldering portions 24 of the lower terminals 22 are in two rows and disposed complementary with each other along the front-to-back direction.

Referring again to FIGS. 1 to 5 and FIGS. 7 to 9, the middle shielding plate 3 is sandwiched between the upper module 140 and the lower module 150 as well as covered by the upper terminals 21 and the lower terminals 22. The middle shielding plate 3 includes a main portion 31, a rear portion 32 and a pair of soldering pins 33 extending from the rear portion 32 and bending downwardly. The main portion 31 and the rear portion 32 are sandwiched between the first tongue portion 142 and the second tongue portion 152. A pair of lateral walls of the main portion 31 is exposed to two sides of the tongue portion 12. The middle shielding plate 3 has a function of grounding which could ensure the stability of the signal-transmitting.

Referring to FIGS. 1 to 6 and FIG. 9, the shielding shell 4 includes a main body 43 and an upper level fixing plate 45 extending from a rear end of the main body 43. The main body 43 is cylindrical shaped and includes an upper wall 431, a bottom wall 432 opposite to the upper wall 431 and a pair of lateral walls 433 connected with the upper wall 431 and the bottom wall 432 forming a mating room 400 therewith. The shielding shell 4 defines an outer surface 41 and an inner surface 42 in the mating room 400. The shielding shell 4 further includes a front edge 44 located at an opening of the mating room 400. The fixing plate 45 is formed at a rear end of the upper wall 431 and extending backwardly. The fixing plate 45 is affixed to the fixing groove 1411.

Referring to FIGS. 1 to 9, the sealer 5 is over-molding with the shielding shell 4 to form a waterproof structure. The waterproof structure includes the mating room 400. The sealer 5 is formed by solidification of liquid silicone. The sealer 5 includes an o-ring 51 and a sealing plate 53 extending from the o-ring 51 and stretching backwardly. The o-ring 51 covers the outer surface 41 of a front end of the main body 43 in the vertical direction and further protectively covers the front edge 44 in the front-to-back direction perpendicular to the vertical direction. The o-ring 51 further includes an inclining portion 52 located at an inner surface of a front end of the o-ring 51. A rear end of the inner surface of the o-ring 51 is smooth connected with the inner surface 42 of the shielding shell 4 to make the corresponded electrical connector insert into the mating room 400 smoothly. The sealing plate 53 is attached to the outer surface 41 of upper wall 431, the bottom wall 432 and the lateral walls 433. The o-ring 51 and the outer metal shell 6 form a stepped shape portion making an shell of an electrical device resist the o-ring 51 in priority and reach a good effect of waterproof.

Referring to FIGS. 1 to 5 and FIGS. 7 to 9, the outer metal shell 6 is affixed to the upper wall 431, the outer surface 41 of the lateral walls 433 and an upper surface of the fixing plate 45.

There exists a filling groove 46 between the circle channel 17 of the base portion 11 and the inner surface 42 of the shielding shell 4. The electrical connector 100 further includes a waterproof board 7 formed by glue and sealing the filling groove 46 to seal a gap between the insulative housing 1 and the shielding shell 4.

The base portion 11 and the connecting portion 13 are located at the mating room 400. The tongue portion 12 is extending forwardly out of the mating room 400. The arrangement could short the length of the electrical connector 100 to achieve the miniaturization of the product. The fixing plate 45 could enforce the strength between the insulative housing 1 and the shielding shell 4 and enlarge the shielding area to make a better effect of shielding shell 4. The fixing plate 45 enlarges the soldering area between the shielding shell 4 and the outer metal shell 6 to make the shielding shell 4 and outer metal shell 6 affix firmly. The outer metal shell 6 is attached to the sealing plate 53 making the sealer 5 affix to the shielding shell 4. The outer metal shell 6 and the shielding shell 4 are fixed together by welding. The soldering spots 61 are away from the sealing plate 53 preventing the sealing plate 53 melting under high temperature.

In the process of making the electrical connector 100, in the first step, provide a contact module affixing a number of conductive contacts 2. The contact module includes an upper module 140, a lower module 150, an insulator 160, a middle shielding plate 3, a number of upper terminals 21 and a number of lower terminals 22. Firstly the upper terminals 21 are insert molding with the upper module 140 as well as the lower terminals 22 are insert molding with the lower module 150. Secondly sandwich the middle shielding plate 3 with the upper module 140 having the upper terminals 21 and the lower module 150 having the lower terminals 22 along a vertical direction perpendicular to the front-to-back direction. At last make the insulator 160 over molding with the contact module to be an insulative module. The insulative module includes a circle ring 17. Provide a shielding shell 4 and liquid silicone in the second step. The shielding shell 4 is formed by stamped stainless. The shielding shell 4 includes a riveting seam 47. Make the liquid silicone over molding a front end of the shielding shell to be a sealer 5 having an o-ring 51 after solidification. The shielding shell 4 and the sealer 5 together compose a waterproof structure. Make the o-ring 51 cover an outer surface 41 of a front end of the shielding shell 4 and a front edge 44. Make a sealing plate 53 of the sealer 5 attach to the outer surface 41 to seal the riveting seam 47. Fix the waterproof structure to the insulative module in the third step. A filling groove 46 is formed between the circle channel 17 and an inner surface 42 of the shielding shell 4. Provide an outer metal shell 6 in the forth step. Solder the outer metal shell 6 to the waterproof structure. Provide waterproof glue in the fifth step. Inject the waterproof glue to the filling groove 46 to be a waterproof board 7 after solidification.

In other embodiments, the shielding shell is formed by metal injection molding. The shielding shell 4 has no riveting seam 47.

Compared with prior arts, the electrical connector 100 has better effects as follows. The sealer 5 is over molding with the shielding shell 4. There exists no gap between the shielding shell 4 and the sealer 5 making a better effect of waterproof. The sealing plate 53 seals the riveting seam 47. The outer metal shell 6 is attached to the sealing plate 53 making the sealer 5 affixed to the shielding shell 4 wherein the outer metal shell 6 includes a front edge forwardly abutting against the sealer 5 in the front-to-back direction, and the sealing plate 53 is sandwiched between the metal shell 6 and the shielding shell 4 in the vertical direction perpendicular to the front-to-back direction. In this embodiment, the sealing plate 53 intimately covers downwardly the upper/outer surface of the shielding shell 4 including the riveting seam 47 thereabouts while the waterproof board 7 intimately covers upwardly the inner surface of the shielding shell 4 including the riveting seam 47 thereabouts, wherein the sealing plate 53 and the waterproof board 7 are partially overlapped with each other in the vertical direction, thus assuring no water leakage through the riveting seam 47. In this embodiment, the sealing plate spans in the transverse direction with a distance less than a full dimension of the main body 43 of the shielding shell 4. while covering the riveting seam 47. Notably, in this embodiment, even though the riveting seam 47 extends through the shielding shell 4 along the front-to-back direction while the sealing plate 53 is terminated around the rear region of the main body 43. It is also noted that the tongue portion 14 extends forwardly beyond the sealer 5. In other words, the shielding shell 4 is substantially a shortened style compared with traditional one which essentially fully covers the whole tongue portion. With this arrangement, the O-ring 51 cover the front edge 44 of the shielding shell 4, and seals the front end of the riveting seam 47.

While a preferred embodiment in accordance with the present disclosure has been shown and described, equivalent modifications and changes known to persons skilled in the art according to the spirit of the present disclosure are considered within the scope of the present disclosure as described in the appended claims.

What is claimed is:

1. An electrical connector comprising:

an insulative housing including a base portion and a tongue portion extending forwardly from the base portion;

a plurality of upper and lower terminals affixed to the insulative housing;

a middle shielding plate affixed to the insulative housing and located between the upper terminals and the lower terminals;

a metallic shielding shell attached to the insulative housing to form a mating room;

an outer metal shell at least partially covering the shielding shell; and a sealer insert-molded with the shielding shell to form a waterproof structure enclosing the insulative housing, the sealer including an o-ring and a sealing plate extending backwardly from the o-ring; wherein a front end of the outer metal shell presses the sealing plate of the sealer against the shielding shell.

2. The electrical connector as claimed in claim 1, wherein:

the shielding shell comprises an outer surface, an inner surface received in the mating room, and a front edge located in front of the mating room; and the o-ring encloses the outer surface of a front end of the shielding shell and the front edge.

3. The electrical connector as claimed in claim 2, further comprising a waterproof board, and wherein the base portion has an annular channel, a filling groove being formed between the annular channel and the inner surface of the shielding shell, the waterproof board filling in the filling groove.

4. The electrical connector as claimed in claim 3, wherein the insulative housing comprises an upper module affixing the upper terminals, a lower module affixing the lower terminals, and an insulator, and the annular channel is formed between a rear end of the upper and lower modules and a rear end of the insulator.

5. The electrical connector as claimed in claim 1, wherein the shielding shell comprises a riveting seam, and the sealer is formed after solidification of liquid silicone and seals the riveting seam.

6. The electrical connector as claimed in claim 1, wherein the o-ring comprises an inclining portion located at a front end of an inner surface thereof, and the inner surface of the shielding shell slides smoothly with a rear end of the inner surface of the o-ring.

7. The electrical connector as claimed in claim 1, wherein the base portion comprises a fixing groove located at an upper surface thereof, the shielding shell comprises an upper wall and a fixing plate extending backwardly from a rear end of the upper wall, and the fixing plate is affixed to the fixing groove.

8. An electrical connector comprising:

a terminal module including a plurality of terminals disposed in an insulative housing;

a metallic shielding shell having a tubular main body to form a mating room and enclosing the terminal module, said shielding shell made of sheet metal and defining a riveting seam extending therethrough along a front-to-back direction; and an insulative sealer overmolded upon an exterior surface of the shielding shell to commonly form a waterproof structure; wherein said sealer includes a front ring circumferentially enclosing a front end region of the shielding shell, and a sealing plate unitarily extending rearwardly from the front ring along the front-to-back direction and covering the riveting seam.

9. The electrical connector as claimed in claim 8, further including a metallic outer shell covering the shielding shell and cooperating with the shielding shell to sandwich the sealing plate therebetween in a vertical direction perpendicular to said front-to-back direction.

10. The electrical connector as claimed in claim 9, wherein the riveting seam extends through the shielding shell along the front-to-back direction while the sealing plate only covers a front portion of said riveting seam in said vertical direction.

11. The electrical connector as claimed in claim 9, wherein the outer shell is soldered upon the shielding shell.

12. The electrical connector as claimed in claim 8, further including a waterproof board made of glue disposed in the housing to seal gaps between the housing and an interior surface of the shielding shell, wherein said waterproof board is at least partially overlapped with the sealing plate in the vertical direction to assure no water leakage via said riveting seam from an exterior.

13. The electrical connector as claimed in claim 8, wherein said front ring is of an "O" configuration and protectively grasps a front edge of the shielding shell.

14. The electrical connector as claimed in claim 13, wherein the housing includes a tongue portion extending forwardly beyond the front edge of the shielding shell.

15. The electrical connector as claimed in claim 8, wherein said shielding shell further includes a fixing plate extending rearwardly from a rear edge of the main body at a higher level, and said riveting seam extends through said fixing plate while said sealing plate is terminated before reaching the fixing plate.

16. The electrical connector as claimed in claim 8, wherein in the terminal module, the terminals are integrally formed with the housing via an insert-molding process.

17. An electrical connector for mating with a complementary connector, comprising: a terminal module including a plurality of terminals disposed in an insulative housing; a metallic shielding shell having a tubular main body to form a mating room and enclosing the terminal module, said shielding shell made of sheet metal and defining a riveting seam extending therethrough along a front-to-back direction; and an insulative sealer overmolded upon an exterior surface of the shielding shell to commonly form a waterproof structure; wherein said sealer includes a front ring circumferentially enclosing a front end region of the shielding shell and protectively covering a front edge of the shielding shell in both the front-to-back direction and a vertical direction perpendicular to said front-to-back direction; wherein said front ring forms an inclining portion at an inner surface of a front end thereof for guiding insertion of the complementary connector into the mating room; wherein the sealer further includes a sealing plate unitarily extending rearwardly from the front ring and seated upon an exterior surface of the tubular main body of the shielding shell; further including a metallic outer shell secured upon the shielding shell with the sealing plate sandwiched therebetween in the vertical direction.

18. The electrical connector as claimed in claim 17, wherein said sealing plate covers the riveting seam in the vertical direction.

* * * * *